United States Patent [19]

Palacino

[11] 4,220,105

[45] Sep. 2, 1980

[54] DEVICE FOR CUTTING AND POSITIONING A CHAIN OF STITCHES ON A SEWING MACHINE

[75] Inventor: Giovanni Palacino, Milan, Italy

[73] Assignee: Rockwell-Rimoldi S.p.A., Milan, Italy

[21] Appl. No.: 11,262

[22] Filed: Feb. 12, 1979

[30] Foreign Application Priority Data

Feb. 17, 1978 [IT] Italy ..... 20359 A/78

[51] Int. Cl.[3] ..... D05B 65/06

[52] U.S. Cl. ..... 112/287; 112/288; 112/253

[58] Field of Search ..... 112/253, 286, 302, 287, 112/288, DIG. 1

[56] References Cited

U.S. PATENT DOCUMENTS

| | | | |
|---|---|---|---|
| 2,988,031 | 6/1961 | Reid | 112/253 |
| 3,690,276 | 9/1972 | King et al. | 112/253 |
| 4,038,933 | 8/1977 | Marforio | 112/253 |

*Primary Examiner*—H. Hampton Hunter

[57] ABSTRACT

A device for orienting a chain of stitches severed from a completed workpiece to a position where the end is taken by a gripping apparatus and the intermediate portion placed in a predetermined location where it cannot be displaced by the next workpiece while incorporating the chain into the initial stitches of the seam being formed thereon.

3 Claims, 5 Drawing Figures

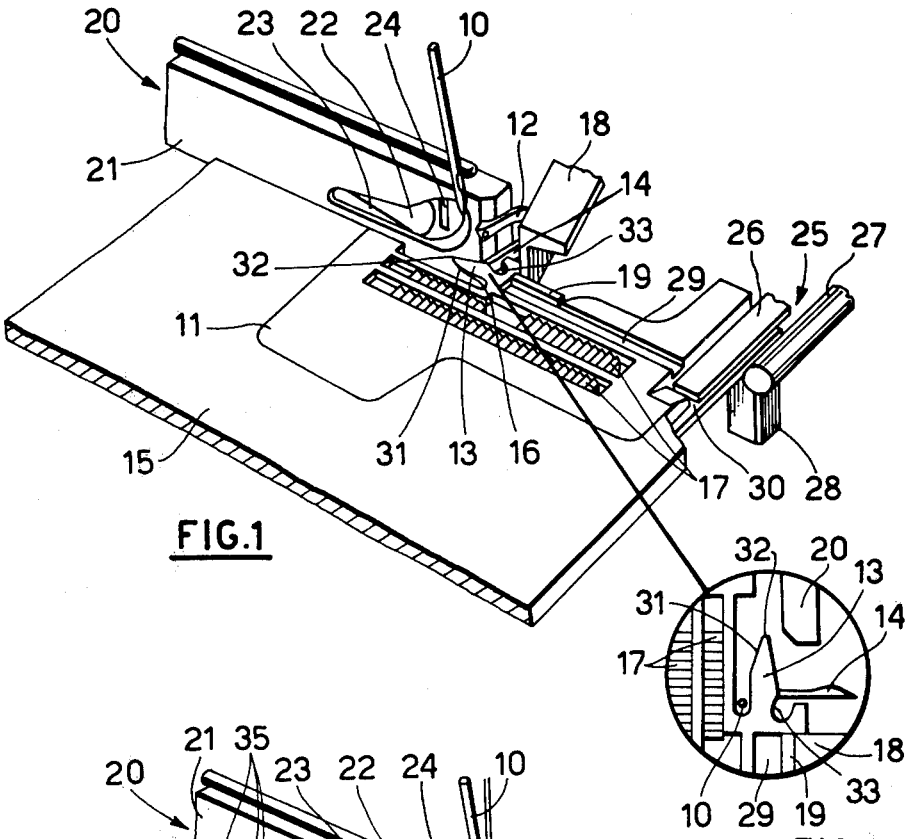
FIG.1
FIG.1a
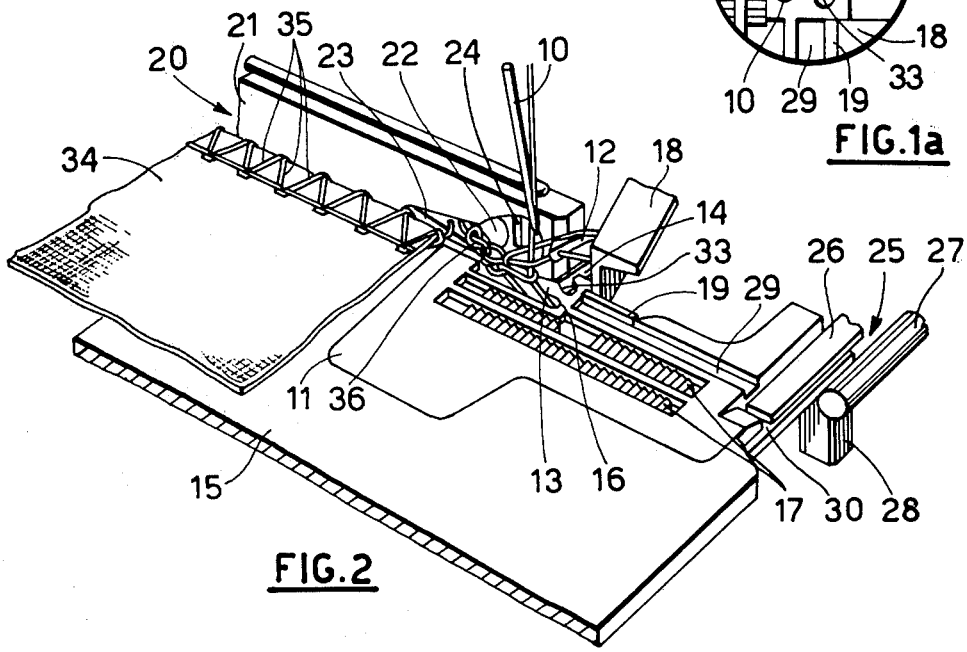
FIG.2

DEVICE FOR CUTTING AND POSITIONING A CHAIN OF STITCHES ON A SEWING MACHINE

BACKGROUND OF THE INVENTION

The present invention pertains to an improved device for use on sewing machines to cut a chain of stitches and hold it in a specific location that facilitates its incorporation into the seam to be formed in the next workpiece.

As is well known, sewing machines that form seams utilizing stitches of the 400, 500, 600, etc. class, according to Federal Standard Catalog (U.S.A.) classifications on a succession of pieces of material, the seam is continued into the area intermediate the pieces of material. With seams of this type means are provided for detaching the pieces of material one from the other by appropriate automatic chain-cutting devices after the sewn pieces have been caused to travel beyond the needle and the presser foot of the machine.

By cutting the chain of stitches with such devices, one portion of minimal length remains attached to the stitched piece of material and the other being connected to the needle plate is manipulated to a position forwardly of the needle so that it can be incorporated into the initial portion of the seam that will be formed on the next piece of material or workpiece. This procedure prevents a slackening of the seam's initial stitches which would give the leading edge of the workpiece an undesireable appearance.

The known devices for performing this function include a chain-cutting device disposed adjacent the tongue of the needle plate which cooperates with a chain-orienting device and gripper apparatus located forwardly of the needle and usually adjacent the forward portion of the needle plate. These devices have not performed their intended function with complete satisfaction for that portion of the chain to be incorporated being located on the upper planar surface of the needle plate intermediate the needle hole, and gripping apparatus is very frequently and inadvertently displaced while positioning the next workpiece in the sewing area.

This inferference of the material to be sewn with the chain prevents the proper insertion of the latter into the new seam being sewn due to the pressure and friction of the piece of material on the chain which tend to dislodge it from the gripping apparatus and move it toward the trimmer knife of the machine that is adjacently disposed, thereby hindering subsequent handling of the chain.

Additionally, the known devices do not provide means for completely dislodging the chain of stitches from the needle plate tongue which is required if one wishes to prevent stitches from being formed before the material engages the needle.

Also, with the known devices the thread extending from the lower looper of the sewing mechanism is linked with the chain and is located on the needle plate in such close proximity to the trimmer knife during the time the chain is being held that it can be easily cut.

An object of the present invention is to improve the known devices so that the chain may be located in a predetermined position in which it will not be affected by the material to be sewn nor damaged by the machine's trimmer knife.

SUMMARY OF THE INVENTION

Regarding devices for cutting, holding and positioning a chain of stitches forwardly of the needle in a sewing machine which includes a chain-cutting device with orienting and gripping devices located in front of the needle, the object of the invention is achieved by an improvement that is characterized by the fact that the needle plate is provided with an integrally formed channel which extends parallel to the sewing axis and also traverses the distance from a point adjacent the needle hole to a position of contiguous relation with the gripping apparatus. This channel is adapted to position the chain that is being held by the gripper apparatus and serves to prevent any contact thereof with the workpiece which could possibly displace said chain.

When a new seam is started the chain is slowly withdrawn from the gripping apparatus and by means of the channel is guided to the stitching instrumentalities and incorporated into said seam.

Another feature of the invention is a shedding means that is integrally formed on the inner side of the tongue intermediate the needle hole and the free end of the tongue. This shedding means is oriented towards the chain-cutting devices and at an angle oblique to the direction of sewing. The shedding means is adapted to cooperate with the suction element of the chain cutting device to assist in withdrawing the chain of stitches from the tongue so that the chain will be drawn to a position spaced from said tongue and in general alignment with the channel in the needle plate.

The shedding device provides a means for effecting positive removal of all of the stitches from the tongue that were formed thereon immediately after completion of the sewing function on the workpiece.

Another feature of the invention is the provision of an arcuated guide slot formed in the base of the tongue and on that side of the latter opposite the needle hole. This arcuated guide slot is adapted to receive and position the threads of the chain of stitches when the latter is ejected from the chain cutting device. Additionally, the guide slot is disposed in close proximity with and is oriented in the direction of the channel in the needle plate and serves to maintain a separation between the threads therein, (especially the thread from the lower looper) and the machine's trimmer knife.

Other features and advantages of the invention will become more fully apparent by reference to the appended claims and as the following detailed description proceeds in reference to the figures of drawings wherein:

BRIEF DESCRIPTION OF THE DRAWINGS

FIG. 1 is a perspective view of a portion of a sewing machine showing the device according to the invention applied thereto;

FIG. 1*a* is a top view of an enlarged scale of the device shown in FIG. 1; and FIGS. 2, 3 and 4 are views similar to FIG. 1 but showing different phases of operation of the device according to the invention.

DESCRIPTION OF THE PREFERRED EMBODIMENT

Figure 3:
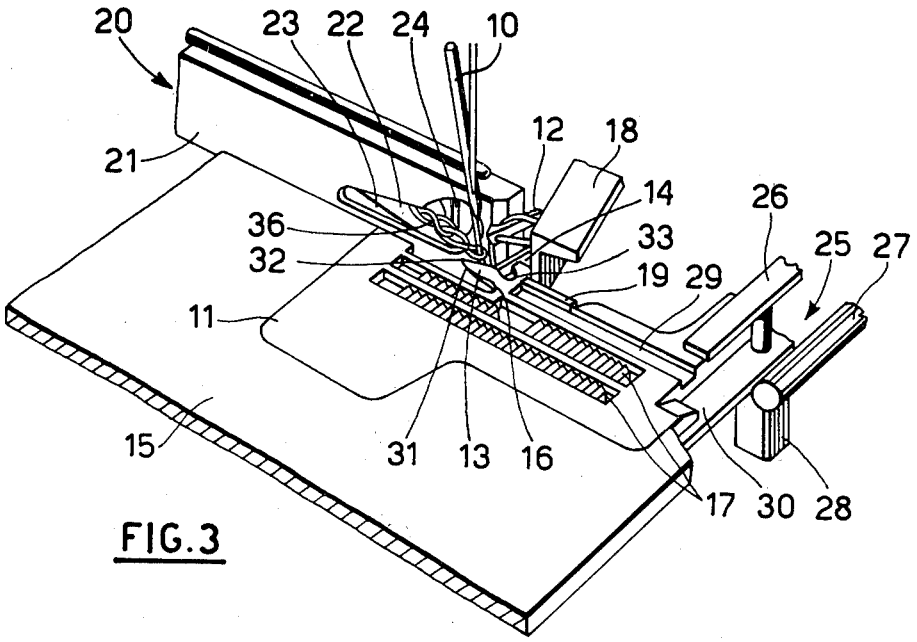

Referring now to FIG. 1, the device for cutting and holding a chain of stitches in a selected position at the beginning of a seam according to the invention, is adapted to be used on a sewing machine of the type that forms an overcast stitch of the 500 class (U.S. Federal Standard Catalog).

As the general construction and operation of a sewing machine to which the present invention is applicable is well known and familiar to those conversant in the art, and as the invention is entirely concerned with a device for positioning a chain of stitches for incorporation into the initial stitches of a new seam, it is only considered necessary here to illustrate and describe those parts which are directly concerned with a preferred form of the invention.

The sewing machine includes among its various parts a needle 10 that is located above a needle plate 11 and an upper looper 12 which is disposed adjacent to a tongue 13 formed on the needle plate and around which the threads are joined to form the stitches for a seam. A lower looper 14 is located beneath the needle plate 11 in a conventionl manner with only a portion thereof being visible in the various figures of drawing.

The needle plate 11 is attached to a work surface 15 of the sewing machine and includes a slot or needle hole 16 into and from which the needle 10 is caused to travel to cooperate in a known manner with the lower looper 14.

One side of the needle hole 16 on the needle plate forms one side of a tongue 13 that extends in the same direction as the direction of feed, i.e., the direction in which the workpieces are caused to advance during the sewing operation by means of a conventional form of feed dog 17.

A well-known trimmer knife 18 and cooperating counterblade 19 are disposed in general alignment with one side of the tongue 13 and serve to trim the edge of the workpiece around which the stitches are to be sewn.

Adjacent the free end of the tongue 13 the machine supports a chain cutting device generally indicated by numeral 20 which includes a suction tube 21 having an opening 22 within which a conventional chain cutting knife 23 is mounted.

An orienting device is disposed within the opening 22 and serves to eject the chain of stitches drawn into the suction tube 21 after being severed from a sewn workpiece. When the chain is ejected it is caused to be extended forwardly of the needle 10 where it is in position to be acted on by a gripping apparatus generally indicated by numeral 25. This gripping apparatus 25 includes a gripper blade 26 and a suction-positioning tube 27.

In particular, the orienting device defines an elongated nozzle 24 that is adapted to direct a jet of air onto the chain so as to eject it from the tube 21 and cause it to extend to a position forwardly of the needle 10 where the end thereof is drawn into the suction-positioning tube 27.

While the end of the chain is being drawn into the suction positioning tube 27, that portion adjacent said end is caused to assume a position beneath the gripper blade 26.

A pneumatic member 28 provides a means for raising and lowering the gripper blade 26 for receiving and gripping the chain in timed sequence with the activation of the suction positioning tube 27.

The improved device according to the invention provides a means for positive positioning of the chain while being acted upon by the gripping apparatus 25 and defines an open channel 29 formed in and communicating with the upper surface of the needle plate 11.

This channel 29 forms an extension of the tongue 13 and extends parallel to the sewing axis from a position adjacent the needle hole 16 to the gripping apparatus 25. The channel 29 communicates with a recess 30 within which the gripper blade 26 is raised and lowered during the performance of its intended function.

The device according to the invention also includes a shedding means which forms an integral part of the tongue 13. This shedding device defines a surface 31 that is disposed at an angle oblique to the sewing axis which extends from the needle hole 16 to the terminus portion of the tongue that is depicted by numeral 32 and which is located adjacent to the opening 22 of the chain cutting device 20.

With the surface 31 of the shedding device being directed at an angle to the sewing axis and toward the chain cutting device 20, it serves to assist the latter in the removal of the stitches from the tongue 13.

An arcuated guide slot 33 is formed on that portion of the base of the tongue 13 opposite the needle hole 16 and extends in the direction which places it in a position of close proximity with the channel 29 (FIG. 1*a*). This guide slot serves to position and align the threads of the chain extending from the stitching instrumentalities after the chain has been released from the tongue 13 so as to align them with the channel 29 while maintaining them at a safe distance from the trimmer knife 18. This feature is of particular importance relative to the thread from the lower looper 14 which is the outermost thread and the one which would otherwise be the one most likely to be damaged by the counter blade 19.

To summarize the operation a seam 35 is shown in FIG. 2 which is formed on the edge of the workpiece 34 as the latter is caused to advance in a known manner during operation of the sewing machine.

Upon completion of the seam, the workpiece continues to advance so as to permit the chain cutting device 20 to draw in the chain of stitches 36 that project from the trailing end of the workpiece and which were formed on the tongue 13.

The drawing-in force of the chain-cutting device is sufficient to cause the above-mentioned chain to be cut off in close proximity with the trailing end of the workpiece This force of drawing in the chain of stitches for cutting is of sufficient strength so as to effect a shedding of the stitches from the tongue 13.

The removal of the chain from the tongue is also facilitated by the shedding device 31, which extends toward the opening 22 so as to taper the body of said tongue in the direction of its end 32.

As shown in FIG. 3 movement of the chain in this manner locates it within the cutting device 20 which is spaced from the needle plate 11 and needle hole 16.

During this function the gripper device 25 is activated so as to be in readiness to receive the chain that has been shed from the tongue 13. The movable gripper blade 26 is moved vertically out of the recess 30 by the pneumatic device 28, and at the same time the suction-positioning tube 27 is activated.

Figure 4:
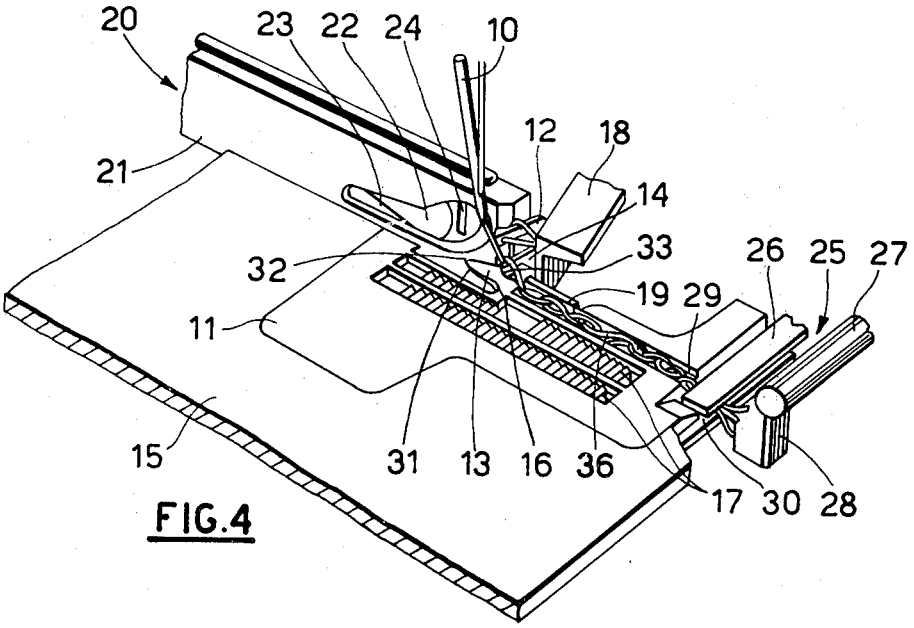

Finally, with regard to FIG. 4, the orienting device 24 emits a jet of air from the nozzle which ejects the chain from the chain-cutting device and orients it in the area forwardly of the needle so that the suction in the tube 27 will draw the chain to a position beneath the blade 26. The blade is then lowered into gripping contact with the chain and in readiness for the next seam to be sewn.

During this function the chain is stretched forwardly so as to enter the recess 33 located at the base of the tongue 13 and enters into the channel 29 thus placing said chain in alignment with the sewing axis and below the upper planar surface of the needle plate 11.

The chain is caused to move in front of the needle and the loopers 12 and 14 to effect its entry into the recess 33 which locates said chain at a sufficient distance from the trimmer knife so as not to come into contact with it accidentally.

Under these ideal conditions, the seam may be picked up only if a new piece of material is moved into contact with the needle 10. The needle on its initial piercing of the material, draws from its source of thread and restores the positions relative to the other stitching instrumentalities that are necessary for the required formation of the stitches. Because stitches at this point can only be formed when a piece of material is present, there is no length of free stitches on the leading edge of the material to affect adversely the appearance of the finished seam.

In addition, the pressure exerted by the workpiece on the work surface 15 and the needle plate 11 cannot displace the chain 36 that is contained within the channel 29. The chain is caused to be pulled from the channel during the formation of a seam in the next workpiece and is sewn or locked into the initial stitches of said seam.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for cutting and positioning a chain of stitches for incorporation into the initial stitches of a seam on a sewing machine of the type having a stitch forming needle and feed mechanism defining the sewing axis with a trimmer knife mounted adjacent thereto and a needle plate with an integral tongue on which the chain of stitches is formed with a suction tube mounted adjacent the needle plate for withdrawing from and receiving the chain formed on the tongue, said cutting and positioning device comprising:

(a) a cutting knife within the suction tube for severing the chain drawn therein from the tongue;

(b) an orienting device within the suction tube for ejecting the severed chain from the latter and directing it to a location forwardly of the needle;

(c) a gripping apparatus for receiving the severed chain ejected by said orienting device; and (d) means traversing the distance between the tongue and said gripping apparatus defining an open channel formed in and communicating with the upper surface of the needle plate for maintaining the chain of stitches below the upper surface of said needle plate and in parallel alignment with the sewing axis to effect the locking in thereof with the initial stitches during its incorporation into the next seam being formed.

2. The device according to claim 1 wherein the tongue includes a shedding device forming one side thereof which extends at an angle oblique to the sewing axis and facilitates the removal of the stitches being withdrawn from the tongue by the suction tube.

3. The device according to claim 1 wherein the tongue includes an arcuated guide slot formed in the base thereof and oriented in the direction of said maintaining means for retaining the threads extending from the chain in spaced relation to the trimmer knife and in general alignment with said maintaining means.

* * * * *